US012213550B2

(12) United States Patent
Sessoms et al.

(10) Patent No.: US 12,213,550 B2
(45) Date of Patent: Feb. 4, 2025

(54) BRA SIZE MEASUREMENT COMPARISON DEVICE

(71) Applicants: Carlisa Renee Sessoms, Roseville, CA (US); Michael Arnold Sessoms, Roseville, CA (US)

(72) Inventors: Carlisa Renee Sessoms, Roseville, CA (US); Michael Arnold Sessoms, Roseville, CA (US)

( * ) Notice: Subject to any disclaimer, the term of this patent is extended or adjusted under 35 U.S.C. 154(b) by 7 days.

(21) Appl. No.: 18/600,478

(22) Filed: Mar. 8, 2024

(65) Prior Publication Data

US 2024/0341387 A1 Oct. 17, 2024

Related U.S. Application Data

(60) Provisional application No. 63/459,055, filed on Apr. 13, 2023.

(51) Int. Cl.
*A41H 1/02* (2006.01)

(52) U.S. Cl.
CPC ..... *A41H 1/02* (2013.01)

(58) Field of Classification Search
CPC ..... A41H 1/02
See application file for complete search history.

(56) References Cited

U.S. PATENT DOCUMENTS

| | | | | |
|---|---|---|---|---|
| 6,272,761 | B1 * | 8/2001 | Pechter | G01B 3/02 33/759 |
| 6,336,839 | B1 * | 1/2002 | Valli | A41H 1/02 450/63 |
| 6,467,180 | B1 * | 10/2002 | Chan | G01B 3/02 33/759 |
| 6,640,460 | B1 * | 11/2003 | Nabarro | G01B 3/1004 33/759 |
| 8,397,391 | B2 * | 3/2013 | Ohly | A41C 3/00 33/2 R |
| 8,832,955 | B2 * | 9/2014 | Petter | A41H 1/02 33/759 |
| 9,568,296 | B2 * | 2/2017 | Moore | A61B 5/4312 |
| 2015/0089824 | A1 * | 4/2015 | Moore | G01B 3/1005 33/512 |
| 2022/0386728 | A1 | 12/2022 | Luthman | |

FOREIGN PATENT DOCUMENTS

ES 1299180 U * 4/2023

* cited by examiner

*Primary Examiner* — Yaritza Guadalupe-McCall
(74) *Attorney, Agent, or Firm* — Plager Schack LLP; Mark H. Plager; Naomi Mann

(57) ABSTRACT

Disclosed is a device for determining a user's bra size. The device comprises a measuring strip with adjustable closure elements and is worn around the user's torso to compare the tightness and feel of different bra size measurements on the body. Band and bust measurements for determining a bra size are adjusted according to the user's subjective comfort and support level and the measurements are converted into bra sizes using charts located on the device. The user can simulate a variety of different band and bust measurement combinations to ensure the best bra size is chosen.

5 Claims, 16 Drawing Sheets

| | Bust 30 | | | | Bust 31 | | | | Bust 32 | | | | Bust 33 | | | | Bu |
|---|---|---|---|---|---|---|---|---|---|---|---|---|---|---|---|---|---|
| Band | US | UK | Band | US | UK | Band | US | UK | Band | US | UK | Band | US | UK | Band | | |
| 29 | 30A | 30A | 29 | 30B | 30B | 29 | 30C | 30C | 29 | 30D | 30D | 29 | 30 | | | | |
| 30 | 30AA | 30AA | 30 | 30A | 30A | 30 | 30B | 30B | 30 | 30C | 30C | 30 | | | | | |
| | | | 31 | 32AA | 32AA | 31 | 32A | 32A | 31 | 32B | 32B | 31 | | | | | |
| | | | | | | 32 | 32AA | 32AA | 32 | 32A | 32A | 32 | | | | | |
| | | | | | | | | | 33 | 34AA | 34AA | 33 | | | | | |
| | | | | | | | | | | | | 34 | 3 | | | | |

| ast 34 | | | | Bust 35 | | | | Bust 35 | | | | Bust 36 | | | | Bust 37 | | | |
|---|---|---|---|---|---|---|---|---|---|---|---|---|---|---|---|---|---|---|---|
| US | UK | Band | US | UK | Band | US | UK | Band | US | UK | Band | US | UK | Band | US | UK | Ban |
| 30D(E) | 30DD | 29 | 30D(D)(F) | 30E | 35 | 35AA | 36AA | 29 | 30G | 30F | 35 | 36A | 36A | 29 | 30H | 30FF | 35 |
| 30D | 30D | 30 | 30D(E) | 30DD | | | | 30 | 30D(D)(F) | 30E | 36 | 36AA | 36AA | 30 | 30G | 30F | 36 |
| 32C | 32C | 31 | 32D | 32D | | | | 31 | 32D(E) | 32DD | | | | 31 | 32D(D)(F) | 32E | |
| 32B | 32B | 32 | 32C | 32C | | | | 32 | 32D | 32D | | | | 32 | 32D(E) | 32DD | |
| 34A | 34A | 33 | 34B | 34B | | | | 33 | 34C | 34C | | | | 33 | 34D | 34D | |
| 34AA | 34AA | 34 | 34A | 34A | | | | 34 | 34B | 34B | | | | 34 | 34C | 34C | |

| | Bust 40 | | | Bust 41 | | | Bust 41 | | | Bust 42 | | | Bust 42 | | | Bust 43 | | |
|---|---|---|---|---|---|---|---|---|---|---|---|---|---|---|---|---|---|---|
| Band | US | UK | Band | US | UK | Band | US | UK | Band | US | UK | Band | US | UK | Band | US | UK | U |
| 35 | 36DD(E) | 36DD | 29 | 30L | 30HH | 35 | 36DD(F) | 36E | 30 | 30L | 30HH | 36 | 36DD(F) | 36E | 31 | 32L | 32B | |
| 36 | 36D | 36D | 30 | 30K | 30H | 36 | 36DD(E) | 36DD | 31 | 32K | 32H | 37 | 38DD(E) | 38DD | 32 | 32K | 32 | |
| 37 | 38C | 38C | 31 | 32J | 32GG | 37 | 38D | 38D | 32 | 32J | 32GG | 38 | 38D | 38D | 33 | 34J | 34C | |
| 38 | 38B | 38B | 32 | 32I | 32G | 38 | 38C | 38C | 33 | 34I | 34G | 39 | 40C | 40C | 34 | 34I | 34 | |
| 39 | 40A | 40A | 33 | 34H | 34FF | 39 | 40B | 40B | 34 | 34H | 34FF | 40 | 40B | 40B | 35 | 36H | 38F | |
| | | | 34 | 34G | 34F | 40 | 40A | 40A | 35 | 36G | 36F | 41 | 42A | 42A | 36 | 36G | 36 | |

| | Bust 46 | | | | Bust 47 | | | | Bust 47 | | | | Bust 48 | | | | Bust 48 | | | | Bust 4 | |
|---|---|---|---|---|---|---|---|---|---|---|---|---|---|---|---|---|---|---|---|---|---|---|
| UK | Band | US | UK | Band | US | UK | Band | US | UK | Band | US | UK | Band | US | UK | Band | US | UK | Band | US | UK | Band | US |
| 34HH | 40 | 46DD(F) | 44E | 35 | 36L | 36HH | 41 | 42DD(F) | 42E | 36 | 38L | 36HH | 42 | 42DD(F) | 42E | 37 | 38L |
| 36H | 41 | 42DD(E) | 42DD | 36 | 36K | 36H | 42 | 42DD(E) | 42DD | 37 | 38K | 38H | 43 | 44DD(E) | 44DD | 38 | 38K |
| 36GG | 42 | 42D | 42D | 37 | 38J | 36GG | 43 | 44D | 44D | 38 | 38J | 38GG | 44 | 44D | 44D | 39 | 40J |
| 38G | 43 | 44C | 44C | 38 | 38I | 38G | 44 | 44C | 44C | 39 | 40I | 40G | | | | 40 | 40I |
| 38FF | 44 | 44B | 44B | 39 | 40H | 40FF | | | | 40 | 40H | 40FF | | | | 41 | 42H |
| 40F | | | | 40 | 40G | 40F | | | | 41 | 42G | 42F | | | | 42 | 42G |

| Bust 53 | | | Bust 54 | | | Bust 55 | | | Bust 56 | | |
|---|---|---|---|---|---|---|---|---|---|---|---|
| US | UK | Band | US | UK | Band | US | UK | Band | US | UK | |
| 42L | 42HH | 42 | 42L | 42HH | 43 | 44L | 44HH | 44 | 44L | 44HH | |
| 42K | 42H | 43 | 44K | 44H | 44 | 44K | 44H | | | | |
| 44J | 44GG | 44 | 44J | 44GG | | | | | | | |
| 44I | 44G | | | | | | | | | | |

105

| | Bust 41 | | | Bust 41 | | | Bust 42 | | | Bust 42 | |
|---|---|---|---|---|---|---|---|---|---|---|---|
| Band | US | UK | Band | US | UK | Band | US | UK | Band | US | UK |
| 29 | 30L | 30HH | 35 | 36DDD(F) | 36E | 30 | 30L | 30HH | 36 | 36DDD(F) | 36E |
| 30 | 30K | 30H | 36 | 36DD(E) | 36DD | 31 | 32K | 32H | 37 | 38DD(E) | 38DD |
| 31 | 32J | 32GG | 37 | 38D | 38D | 32 | 32J | 32GG | 38 | 38D | 38D |
| 32 | 32I | 32G | 38 | 38C | 38C | 33 | 34I | 34G | 39 | 40C | 40C |
| 33 | 34H | 34FF | 39 | 40B | 40B | 34 | 34H | 34FF | 40 | 40B | 40B |
| 34 | 34G | 34F | 40 | 40A | 40A | 35 | 36G | 36F | 41 | 42A | 42A |

FIG. 10

BRA SIZE MEASUREMENT COMPARISON DEVICE

RELATED APPLICATION

This application claims a priority to U.S. Provisional Application No. 63/459,055 filed Apr. 13, 2023, which is incorporated by reference herein in its entirety.

FEDERALLY SPONSORED RESEARCH OR DEVELOPMENT

Not Applicable

NAMES OF PARTIES TO A JOINT RESEARCH AGREEMENT

Not Applicable

INCORPORATION BY REFERENCE OF MATERIAL SUBMITTED

Not Applicable

PRIOR DISCLOSURES BY THE INVENTOR OR A JOINT INVENTOR

Not Applicable

SEQUENCE LISTINGS

Not Applicable

TECHNICAL FIELD

The present invention relates to measuring and fitting devices for determining a bra size. More specifically the invention encompasses improvements related to bra fitting by allowing the user to compare the comfort and support of different bra size measurements on the body and self-assess which measurement sizes are the best choice based on feel. The invention further encompasses improvements by providing a comprehensive bra fitting device that includes bra size measurement conversion charts to assist with converting the measurements into bra sizes.

BACKGROUND

Since the invention of the "Brassiere" bras have been worn as a supportive undergarment for breasts. However, there have been challenges in establishing a clear and concise way to educate individuals, particularly those not trained in the art of bra fitting on how to accurately determine a correct bra size.

Ill-fitting bras can cause various problems including discomfort to the wearer and an unappealing silhouette in the external clothing, amongst others. Potential negative consequences of wearing an ill-fitting bra may include, but are not limited to: premature sagging of breast tissue due to lack of support; indentations in the shoulders due to bra strap pressure; chaffing and welting on the skin around the rib cage due to constricting band sizes; discomfort and scarring on the breasts from bra wires digging into breast tissue; constricted diaphragm expansion which may be caused by wearing an over-tight bra; hygiene challenges from sweat accumulation under the breast tissue, which can develop into skin rashes and/or foul odors; poor posture which may lead to back problems; breasts appearing larger than they actually are and/or spillage out of the bra cup; and the uncomfortable annoyance of needing to constantly and repeatedly readjust the bra while wearing it.

Conventional methods for individuals to find their correct bra size are to be measured by a professional bra fitting specialist at a retail establishment, and/or measure themselves using a measuring tape. Individuals that choose to measure themselves may run into difficulty with trying to convert the measurements into actual bra sizes if they are not trained in the art of bra fitting. Because a typical measuring tape has multiple generic applications, it does not address the specific need of measurement calibration to bra size, and how comfortable the chosen size will feel on the body. With a measuring tape there is room for human error and inconsistent measuring depending on how much tension is used against the body while measuring. Consequently, an individual can determine their bra size using a measuring tape, and because there is no way to wear the measuring tape to test and feel the tightness of a chosen measurement, an actual bra in a size ascertained by the measuring tape may possibly feel uncomfortably tight or loosely unsupportive once it is on the body. The individual is then left to trial and error means of trying on multiple bra sizes, possibly without understanding how to adjust the band to cup ratio of a bra size, which can lead to frustration and confusion.

Additionally, the professional help of a bra fitting specialist may not be readily available and/or a practical option for many consumers. Being measured by a stranger may make certain individuals feel uncomfortable. Many retail establishments do not offer bra fitting services and more consumers are purchasing bras online. As a result, consumers may simply base their size selection for a new bra purchase according to their most recently known size, without considering that their bra size may have changed. On average an individual can change their bra size up to six or more times during their life span. Events such as puberty, pregnancy, breast feeding, weight fluctuations, hormonal changes, and menopause, are key life stages that typically cause changes in an individual's bra size. As such a bra sizing device that is easy to use without the help from a third party is needed.

In the art of bra fitting, a bra size is determined by the ratio between a person's torso and how far out the breast tissue protrudes from the torso. The first step in determining a bra size is to measure the circumference of a person's torso directly under the bust (underbust measurement) to obtain the band size. The second step is to measure the circumference of a person's torso around the fullest part of the bust at the apex (overbust measurement) to determine their cup size. In the U.S. these measurements are usually in inches. One is then to calculate the difference between the two measurements. The difference of one inch is an A cup, two inches is a B cup, three inches is a C cup and so forth.

Because the cup size letter denotes how many inches away from the torso the breast protrudes, it is imperative to determine an accurate underbust measurement. For example, if one has an underbust measurement of 36 and an overbust measurement of 40 this person would have a four-inch difference and would wear a 36D bra size. Yet, if another person has an underbust measurement of 34 and an overbust measurement of 40 this person would have a six inch difference and would wear a 34F bra size. Although both examples measure the same overbust circumference of 40, there is a size difference of two cup sizes due to the different underbust measurements taken. It is possible for those untrained in the art to assume that bust size equals cups size. However as illustrated by the previous example the same overbust circumference can be multiple cup sizes depending on the underbust measurement taken.

Another reason why establishing the correct underbust measurement is crucial to obtaining an optimally fitting bra, is because most of the bra's support comes from the underbust measurement or band size. How tightly the bra band fits, determines how high the bra band can stay in place around a person's torso under their bust. The tighter the band the higher the base support level will be to lift the breast tissue resulting in a more supported look from the bra size. The looser the band the more relaxed the bra band will feel. However, if the bra band is too loose, there will not be enough base support under the bust to properly lift the breast tissue. As a result, the bra band can sit lower on the torso resulting in a sagging appearance, breasts can fall out of the bottom of the cups, the bottom of the cups can move around and chafe the torso from not being anchored properly, and/or the straps are left to carry the weight of the breast resulting in the straps digging into the wearer's shoulders. Conversely, if the bra band is too tight, the bra will be uncomfortable to wear possibly leaving the skin irritated around the wearer's torso.

It would appear that if a person measures a certain size that the bra size chosen would correlate to the size measured. However, in practice this is not always the case. Just because an individual measures a certain size does not mean that the measured size is the most desirable fit for the individual. Many individuals feel constrained in their measured bra band size and end up wearing one to two sizes larger than what they actually measure. Some professional bra fitters use the practice of adding up to five inches to the underbust measurement to ensure that the bra band does not fit too snugly. However, if too many inches are added to the underbust measurement of certain individuals (in particularly larger busted individuals) there will not be enough base support from the bra band to properly lift the breast tissue. As such, a bra size is subjective to the constraint tolerance of an individual and not necessarily an exact measurement. Because of this a bra fitting device is needed that adjusts the cup to band size ratio of a bra size according to how tightly or loosely an individual wishes their bra size to fit.

An example of needing such a device would be an individual who determines their bra size is 34C using the traditional bra sizing technique with a measuring tape. This individual would have an underbust measurement of 34 and an overbust measurement of 37. The individual tries on a bra in 34C and determines it feels too tight. If the individual is untrained in the art of bra fitting, they may change the band size to the next size up without adjusting the cup size. This will result in a size selection of 36C which would be a more relaxed band size, but the cup size would be too large. The proper adjustment would be to recalculate the size with an underbust measurement of 35 and the same overbust measurement of 37 which results in the correct adjustment size of 36B. This example illustrates the need for a bra size comparison device based on feel that automatically adjust the band to cup ratios for the user, rather than solely relying on measurement readings typically done by a measuring tape.

Moreover, bra band sizes are typically even-numbered sizes (e.g., 32, 34, 36, etc.). If one is not trained in the art of bra fitting, the wrong cup size could possibly be determined if an odd numbered underbust measurement is taken. Typically, if an odd numbered underbust measurement is chosen the band size is rounded up to the next even number. For example, an underbust measurement of 35 would correspond to a bra band size of 36. One untrained in the art may use 36 when determining the cup size rather than the specific underbust measurement of 35, which can lead to an inaccurate size. For example, if an overbust measurement is determined to be 38 and an underbust measurement is determined to be 35, using the rounded-up band number may lead to an incorrect determination of 36B rather than the correct size of 36C. A clear and concise way of converting measurements into bra sizes is needed. Establishing a comfortable underbust measurement that provides optimal support is imperative to ascertaining the correct bra size. This can better be accomplished if an individual is able to feel and compare the tightness and support of different underbust measurement sizes.

Trying to assimilate this bra fitting information, do mental calculations and determine whether a chosen size will fit comfortably supportive can be overwhelming and frustrating for anyone untrained in the art of bra fitting.

DESCRIPTION OF PRIOR ART

There have been many attempts to provide solutions to these bra fitting challenges. Some measuring tapes have been specifically engineered for the use of bra fitting such as in the case of U.S. Pat. No. 3,292,261 in the name of Hayes, U.S. Pat. No. 6,467,180 in the name of Chan, and U.S. Pat. No. 8,832,955 in the name of Petter. However as previously stated, measuring tapes do not allow the user to wear and compare the feel of different measurement sizes. Because of this, some of these measuring tapes use the methodology of adding inches to the user's underbust measurement and/or relying on the user to estimate how many inches to add to the underbust measurement to determine a comfortable band size. This vague estimation of how many inches to add can lead to the wrong bra size being chosen if the user is not trained in the art of bra fitting or result in trial and error means of trying on multiple sizes to determine the correct size.

There have been some inventions that do allow the user to wear a device to determine their correct bra size such as in the case of U.S. Pat. No. 6,276,069 in the name of Chadwick, U.S. Pat. No. 5,414,943 in the name of Vogt, U.S. Pat. No. 9,568,296 in the name of Moore, Patent No. US20220386728 in the name of Luthman, and U.S. Pat. No. 2,946,125 in the name of Gittelson. However, many of these devices do not readily show the measurement combinations of band to bust ratios that adjust the cup size according to the band size chosen. Some require the user to wear the device attached to their back which may be difficult for users with limited mobility. Some use spring systems which can mechanically malfunction. Some use multiple measuring tapes which may be less intuitive to use compared to the claimed invention. Some of these devices are intended to be used on bare breast which may be awkward if ever in the presence of a third party, such as with a bra fitting specialist.

To address these issues, the disclosed subject matter provides an improved bra sizing device and method that is comprehensive and easy to use without the needed assistance from a third party.

SUMMARY

In the art of bra fitting a bra size may be determined using a measuring tape, but once an actual bra is worn on the body in the size determined by the measuring tape, the bra itself may possibly feel uncomfortably tight or loosely unsupportive to an individual. Establishing the correct measurements for bra sizes can more accurately be determined if the tightness of a bra size measurement is able to be felt on the body and a bra size is chosen according to the subjective constraint tolerance of an individual. Because the bras size can change if the underbust measurement is adjusted by just one inch, a bra size measuring device is needed that reads and adjusts bra sizes according to which band circumference inch an individual chooses based on the individual's fitting preferences.

It is the object of the disclosed invention to overcome or at least mitigate the issue of selecting a bra size that may feel uncomfortably tight or loosely unsupportive, by providing a bra fitting device which allows the user to test and compare the tightness, comfort, and support of different bra size measurements on the body within one-inch increments. The invention limits the trial and error means of finding a correct bra size by removing the vague estimation of how many inches to add to an underbust measurement to determine a comfortable band size. The disclosed device and method allow the user to determine bra size based on subjective feel enabling the user to select a bra band size according to how tightly or loosely they wish their bra size to fit. The cup size is adjusted according to the underbust band measurement chosen. It is further the object of the disclosed invention to provide a comprehensive bra fitting tool that simplifies the bra fitting process by including bra size conversion charts that convert the underbust and overbust measurements into bra sizes.

In certain embodiments, the invention disclosed is a bra size measurement comparison device comprising a measuring strip, a first closure element, a row of second closure elements, and a group of bra size measurement conversion charts. The measuring strip comprises a length of continuous strip material having a first surface and a second surface opposite said first surface. The first surface being the front or first side outer surface of the measuring strip and the second surface, opposite said first surface, being the rear or second side outer surface of the measuring strip. The measuring strip further comprises having a common top linear edge and a common bottom linear edge, the top linear edge and the bottom linear edge being oppositely disposed and spanning the length of strip material. The measuring strip further includes a first side edge extending between the first end of the top linear edge and the first end of the bottom linear edge, and a second side edge extending between the second end of the top linear edge and the second end of the bottom linear edge. The first edge and the second edge span across the width of strip material, width being shorter than the length such that the measuring strip provides a long and narrow band. The first closure element may be attached proximate the first end of the measuring strip. The row of second closure elements may be attached to the first or second surface of the measuring strip. Each second closure element within the row of second closure elements is labeled and/or numbered and each label and/or number of the second closure elements corresponds to a distinct circumference measurement size of the measuring strip. The first closure element and each second closure element within the row of second closure elements comprise any means of fastening.

In some embodiments, the first closure element may be configured to independently fasten to each second closure element within the row of second closure elements so that the measuring strip forms a loop and may be worn around a user's torso while measuring to obtain an underbust measurement and an overbust measurement, wherein the measuring strip is self-supporting when worn around the torso and omits both breast cupping and shoulder straps. In wearing the measuring strip and fastening the first closure element to different individual second closure elements, the user may feel and compare the tightness and constraints of different underbust and overbust measurements on the body and choose the most desired underbust and overbust measurements according to the user's subjective constraint tolerance.

In some embodiments, the group of bra size measurement conversion charts is located on either the first or second surface of the measuring strip wherein the group of bra size measurement conversion charts convert the measurements taken by the measuring strip into an exact bra size. The group of bra size conversion charts may display a single bra size metric system or multiple bra size metric systems from different world regions and/or countries, and an exact bra size may be displayed one way or displayed multiple ways with different numbering and/or lettering so that the exact bra size may correspond with one bra sizing metric system or different bra sizing metric systems used in different world regions and/or countries.

In certain embodiments disclosed is a method for determining bra size of a pair of breasts, comprising the steps of: wrapping a measuring device around a torso at an apex of the pair of breasts, wherein the measuring device omits both breast cupping surfaces and shoulder straps. The measuring device comprises a length of continuous and narrow strip material having a top linear edge and a bottom linear edge, and having a first closure element and a row of second closure elements, wherein each second closure element within the row of second closure elements may be labeled and/or numbered and corresponds to a distinct circumference measurement size of the measuring device; fastening the first closure element of the measuring device to one of the second closure elements within the row of second closure elements on the measuring device so that the device may be worn self-supportively around the apex of the breasts and obtain an overbust circumference measurement size of the torso; comparing the tightness and constraints of different overbust circumference measurement sizes of the measuring device around the apex of the pair of breasts by fastening the first closure element of the device to different second closure elements on the device; choosing an overbust circumference measurement size from the different overbust circumference measurement sizes compared; wrapping the measuring device around the torso directly under the pair of breasts; fastening the first closure element of the measuring device to one of the second closure elements within the row of second closure elements on the measuring device so that the device may be worn self-supportively directly under the pair of breasts and obtain an underbust circumference measurement size of the torso; comparing the tightness and constraints of different underbust circumference measurement sizes of the measuring device under the-pair of breasts by fastening the first closure element of the device to different second closure elements on the device; choosing an underbust circumference measurement size from the different underbust circumference measurement sizes compared that is the desired tightness around the torso under the pair of breasts and keeps the measuring device securely in place at the desired position around the torso under the pair of breasts; and referencing bra size conversion charts that have overbust and underbust circumference measurements listed with corresponding bra sizes and finding the chosen overbust and underbust circumference measurements on the charts to determine an exact bra size.

In certain embodiments the tightness and constraint of the measuring strip around the user's torso when measuring the underbust simulates the tightness and constraint of a bra band in a chosen measurement size. As such the user will be able to feel the tightness and constraint of a chosen size when the rib cage expands during inhalation ensuring that the chosen size won't be too tight. Wearing the device enables range of motion testing to determine if a chosen size will stay in place around the torso of the user when measuring the underbust. The user may determine the support level of an underbust measurement by the orientation of where the device sits around the user's torso (while in a closed loop position), in relation to the lower breast roots of the user's bust. By adding the closure elements to a bra fitting device the user can feel and adjust the support level of their bra band size in one inch increments which can provide a more accurate size selection. If the user wishes to have more support, they can tighten the device to a smaller measurement to keep the device in place higher up the torso closer to the underbust breast roots. If the user wishes to be more comfortable, they can loosen the device and check to see how far down the torso the device sits further away from the underbust breast roots. The user will be able to make sure that the underbust measurement size chosen won't slip too far down the torso which could result in a bra band size with not enough support.

The user can also adjust the tightness of the device when measuring their overbust measurement to determine if the proper bust measurement size is being chosen. The user will be able to feel if an appropriate overbust measurement size has been chosen if the device is able to stay in place securely around the apex of the bust without the need of having to hold the device in place. If the device slips down off the bust the user will know to tighten the measurement size. If the device feels constricting or excessively compresses the breast tissue while measuring the bust, the user will know to loosen the measurement size. By feeling how much tension is on the bust when measuring the bust, a more accurate cup size can be determined in correlation to the band size chosen by the user.

Offering an "on-the-body" demonstration of how tightly or loosely chosen bra size measurements feel, allows for the bra size to be adjusted depending on if the user wishes to be more comfortable or have more support. A user can make a more accurate determination of their desired bra size based on their subjective comfort and support level instead of merely relying on the readings of a measuring tape. In doing so the user can have confidence that once an actual bra is on the body the bra size chosen will be comfortable to wear.

By providing bra sizing charts directly on the measuring strip, the disclosed invention provides a way for anyone untrained in the art of bra fitting to determine an accurate bra size without the help of a third party. The charts automatically adjust the bra size according to which band and bust measurements are chosen allowing the user to compare different sizes to determine for themselves their best fitting bra size. The simplicity of the invention helps to remove the guess work and assumptions that can be made during bra fittings which may lead to an inaccurate size determination. The disclosed invention can be used over a tight fitting shirt or an existing bra if the bra does not have additional padding. This feature renders the disclosed invention more convenient and less socially awkward if being used in the presence of a third party. The invention described herein is light weight, compact and portable which can be used anywhere including a store dressing room, or in the privacy of a home, which may be particularly useful when purchasing bras online.

In one embodiment of the invention the measuring strip is non stretchable and made of soft fabric to mimic the feel of an actual bra band when measuring the underbust of the user. This will provide the user with a better simulation of how the chosen measurement size will feel once a bra is worn on the body.

In one embodiment of the invention the measuring strip is made of fiberglass material resembling a measuring tape. This will allow the device to be wiped down and sanitized between uses which can be beneficial for a professional bra fitter using the device to service multiple customers.

In one embodiment of the invention the measuring strip is made of an elastic band wrapped in polyester material. The elastic band is used to give the measuring strip thickness and structure for a sturdier feel on the body. The polyester is used to keep the band from stretching.

In one embodiment of the invention the bra size conversion charts may show the bra size according to different geographic world regions. The U.S. size and the U.K. size of a bra size may be displayed on the same chart. Other geographic world region sizing may also be interchanged. This will help the user when shopping different lingerie brands that may use sizing metrics from different geographic world regions.

In one embodiment of the invention additional bra fitting information may be printed on the measuring strip to further assist the user with bra fitting. The additional information may include but is not limited to bra style suggestions, bra fitting tips, and directions on how to use the device.

In one embodiment of the invention the device measures 60 inches in length and 1½ inches in width. The closure elements are designed to measure the circumference sizes of 27 inches to 56 inches. This will allow for a bra fitting range of 28AA-44L (U.S.) or 28AA-44HH (U.K.). The width of the device in this embodiment is designed to accommodate two eye loops per inch increment representing the second closure elements along with the corresponding two hooks at the end of the device representing the first closure element. This double hook and eye loop configuration on the measurement increments is intended to mimic the hook and eye loop configuration of most bra back closures. The length of the device in this embodiment is intended to mimic the length of a typical flexible tailor's measuring tape. The length and width features of this embodiment are designed to be familiar to most users to limit the learning curve needed to use the invention. The length and width also accommodate a range of bra sizes that many users would fall in.

In one embodiment of the invention the measuring device is shortened, and the size range is limited. This embodiment may be intended to appeal to a younger user who may be developing breast and/or going through puberty.

In one embodiment of the invention the device is extended to accommodate larger sizes. The cup size range may start at a D cup and be extended to a K cup (U.K.). This embodiment may be intended to service larger busted individuals.

In one embodiment of the invention the first closure element is a pair of hooks, and the second closure elements are eye loops. The eye loops may be attached directly to the measuring strip for a sleeker appearance or may be sewn into material resembling parts of a bra extender and subsequently attached on top of the measuring strip. Attaching the eye loops to portions of material resembling bra extenders and then attaching the portions of material onto the measuring strip allows for the eye loops to be slightly raised, which will make fastening the hooks to the eye loops easier.

BRIEF DESCRIPTION OF THE FIGURES

The detailed description of some embodiments of the invention will be made below with reference to the accompanying figures, wherein the figures disclose one or more embodiments of the present invention:

FIG. 7A illustrates a first section of the device.

FIG. 7B illustrates a second section adjacent to the first section.

FIG. 7C illustrates a third section adjacent to the second section.

FIG. 7D illustrates a fourth section adjacent to the third section.

FIG. 7E illustrates a fifth section adjacent to the fourth section.

FIG. 7F illustrates a sixth section adjacent to the fifth section.

FIG. 7G illustrates a seventh section adjacent to the sixth section.

FIG. 7H illustrates an eighth section adjacent to the seventh section.

FIG. 7I illustrates a ninth section adjacent to the eighth section.

FIG. 10 shows an exemplary bra size measurement conversion chart wherein the color and/or shading of each section of the bra size measurement conversion charts alternate.

DETAILED DESCRIPTION OF THE INVENTION

According to various embodiments, the invention will now be described with reference to FIGS. 1 to 10.

Figure 1:
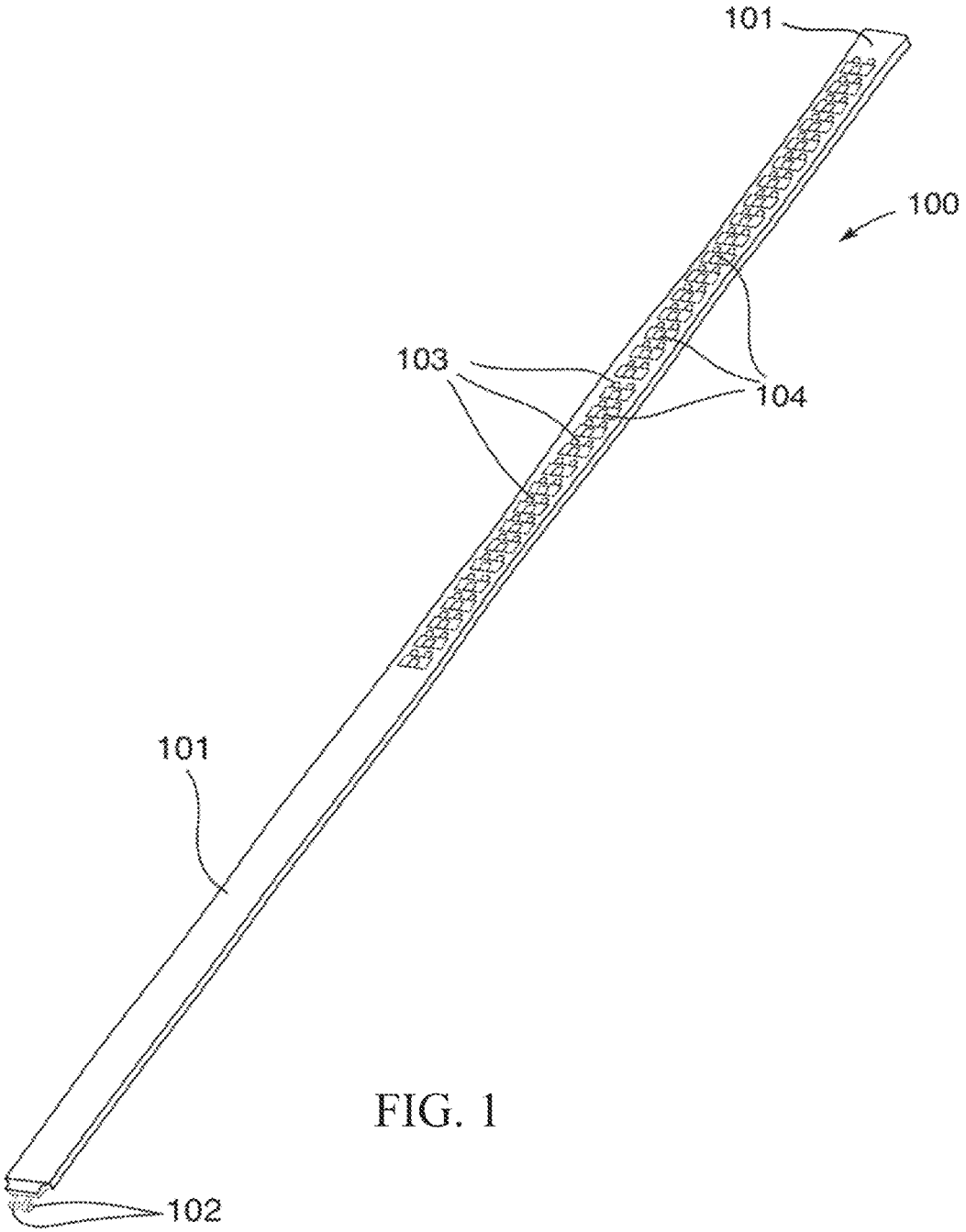
FIG. 1 is a front or first side prospective view of the present invention.
Figure 2:
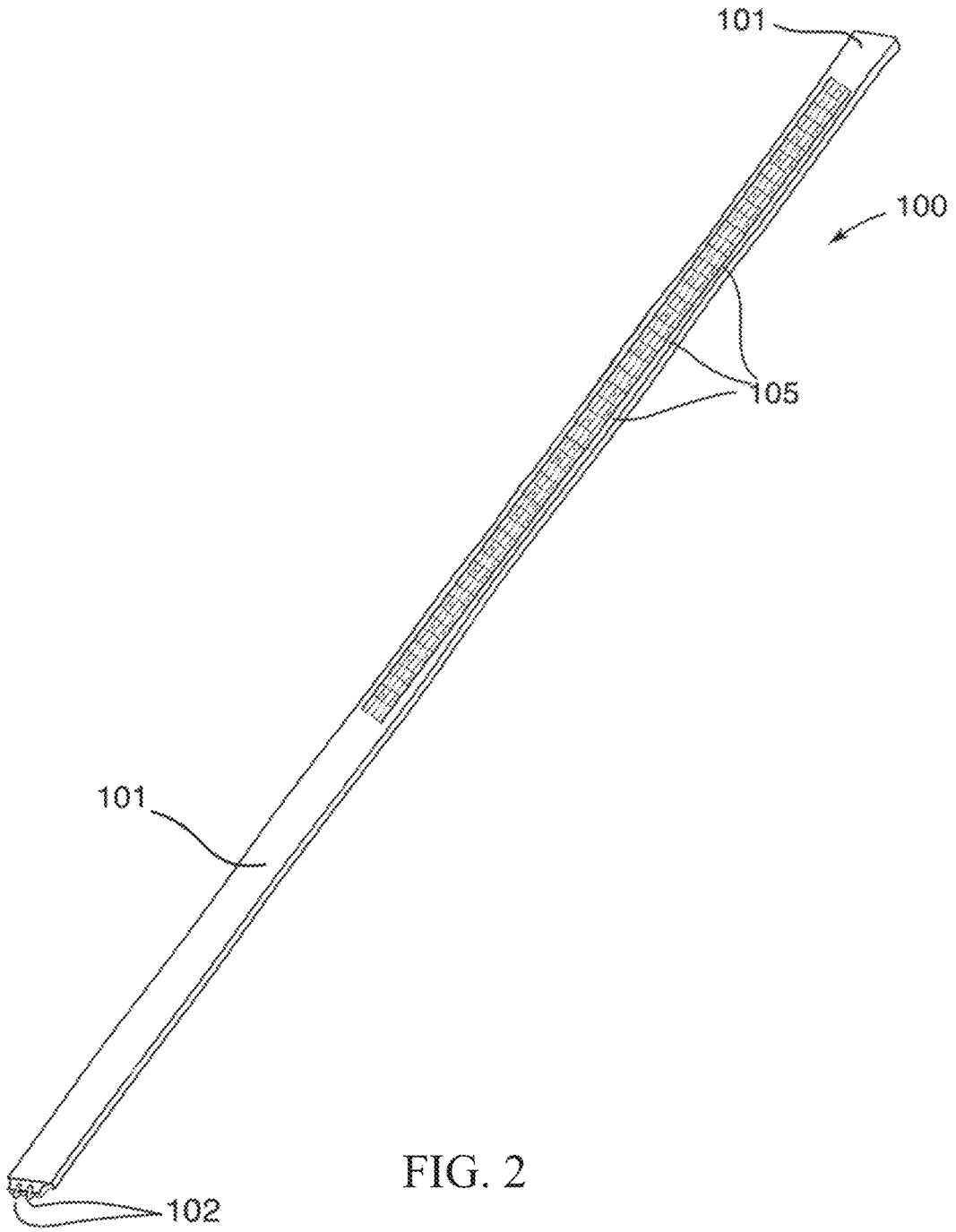
FIG. 2 is a rear or second side perspective view of the present invention.
Figure 3:
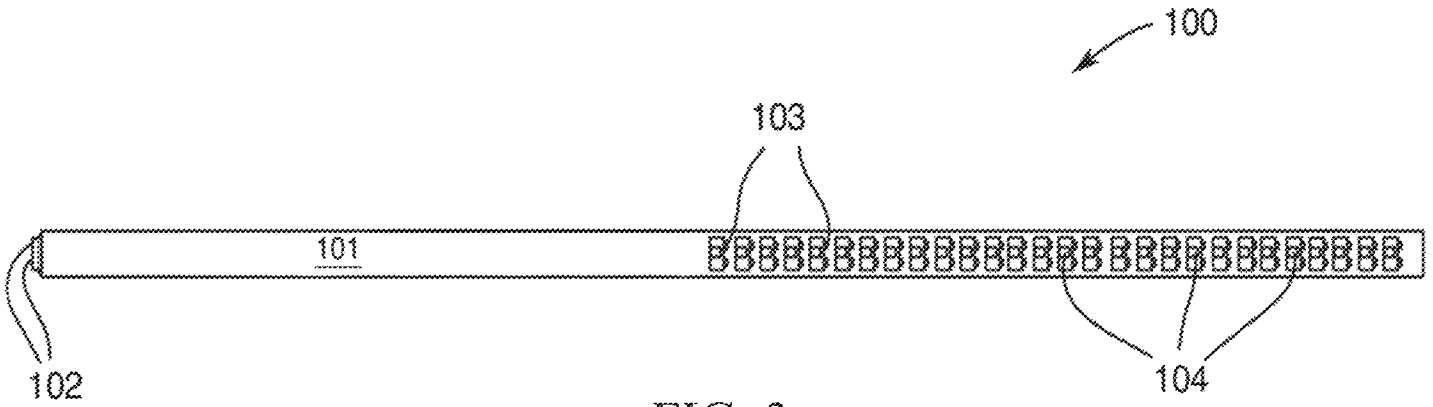
FIG. 3 is a front or first side plan view of the present invention.
Figure 4:
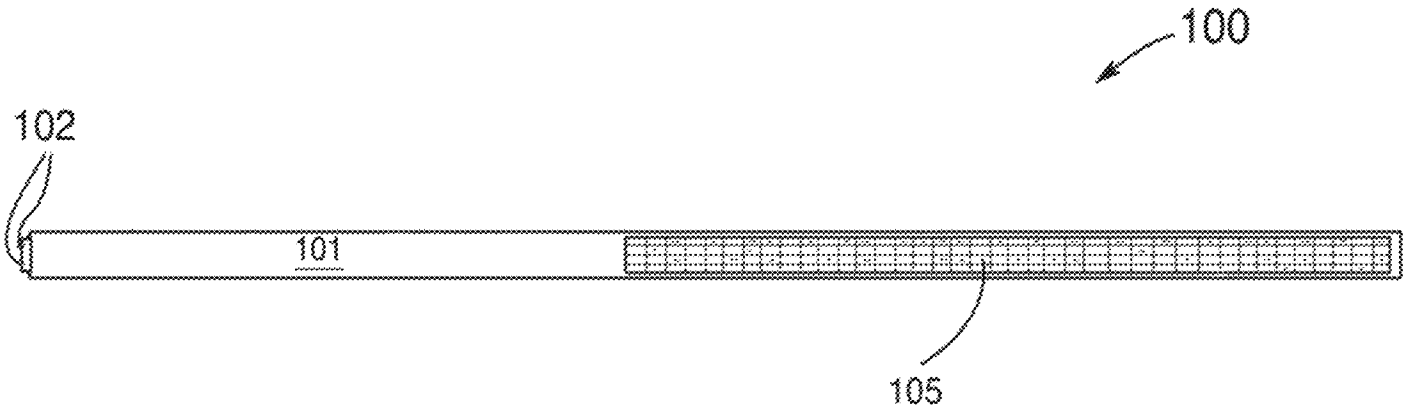
FIG. 4 is a rear or second side plan view of the present invention.

FIG. 1 and FIG. 3 shows a front or first side of the bra size measuring device 100. FIG. 2 and FIG. 4 shows a rear or second side of the bra size measuring device 100. The bra size measuring device 100 comprises a measuring strip 101, a first closure element 102, a row of second closure elements 103, number indicia 104, and bra size measurement conversion charts 105.

To make the invention a measuring strip 101 is assembled out of any material. The measuring strip 101 may be made of fiberglass material resembling a measuring tape, fabric material, or any other material suitable for measuring a torso. The measuring strip 101 is the main structure of the bra size measuring device 100 and is essentially non stretchable.

According to the exemplary embodiment the measuring strip 101 may be formed by assembling three strips of fabric together. The strips of fabric may be 60 inches in length and 1½ inches in width. Two strips of fabric may be the outer layers of the measuring strip 101 and one strip of fabric may be the inner layer of the measuring strip 101. The outer layer strips of fabric material may comprise a combination of spandex, nylon, polyester, silk, rayon, or any other soft material. The strip of fabric for the inner layer of the measuring strip 101 is a material that is essentially non-stretchable. The inner layer may be a cotton and polyester blend or any other non-stretch material. The three layers of fabric may be sewn together or fused together with fabric adhesives. The purpose of constructing the measuring strip 101 with an inner layer and outer layers of fabric material is so that the measuring strip 101 may feel soft on the body while maintaining a non-stretchable structure to obtain accurate measurements. Using fabric may better simulate the tightness of an actual bra band size on the body when measuring the underbust measurement.

Figure 5:
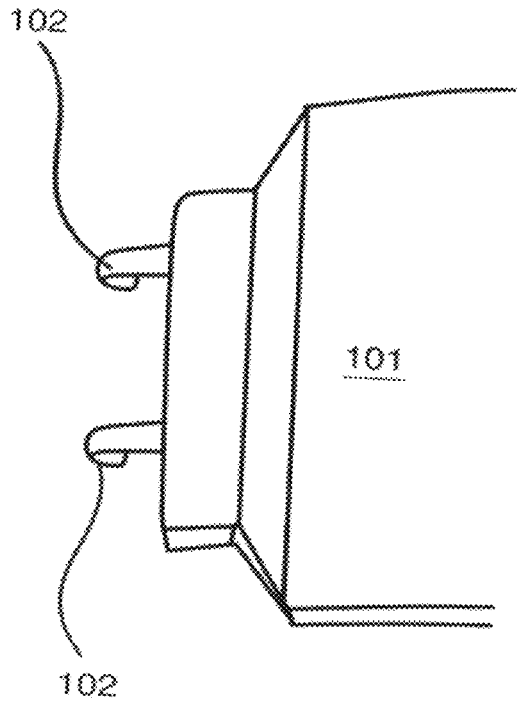
FIG. 5 is an enlarged perspective view of the first closure element.

As shown in FIG. 1 and FIG. 3, when the front or first side of the measuring device 100 is facing up, the first closure element 102 is located on the far-left side of the measuring device 100 at the end of the measuring strip 101. According to the exemplary embodiment a pair of hooks are used as the first closure element 102 resembling the hooks found on bra back closures. FIG. 5 shows an enlarged prospective view of the first closure element 102 as hooks. According to the exemplary embodiment the first closure element 102 hooks are sewn and/or attached at the end of the measuring strip 101 along the width or transverse axis of the measuring strip 101.

The second closure elements 103 are attached to the front side of the measuring device 100 along the first surface of the measuring strip 101. According to the exemplary embodiment the second closure elements 103 may be eye loops resembling eye loops found on bra back closures. The second closure elements 103 eye loops are sewn with the closed end of the eye loops facing right aligned to correspond with the position of the first closure element 102 hooks. It shall be understood that the first closure element 102 hooks and the second closure elements 103 eye loops are oriented in appropriate directions for interlocking engagement. The first closure element 102 and the second closure elements 103 are configured to fasten together so that the measuring device 100 may be worn around a user's torso.

Figure 6:
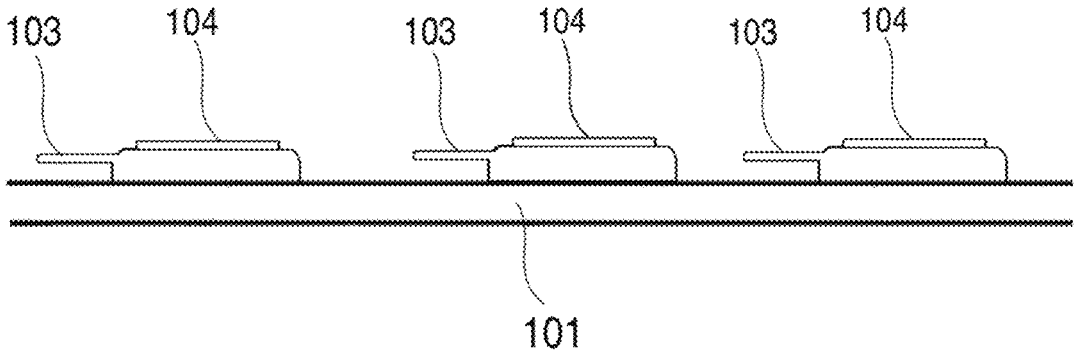
FIG. 6 is an enlarged elevation view of the second closure elements.
Figure 7A:
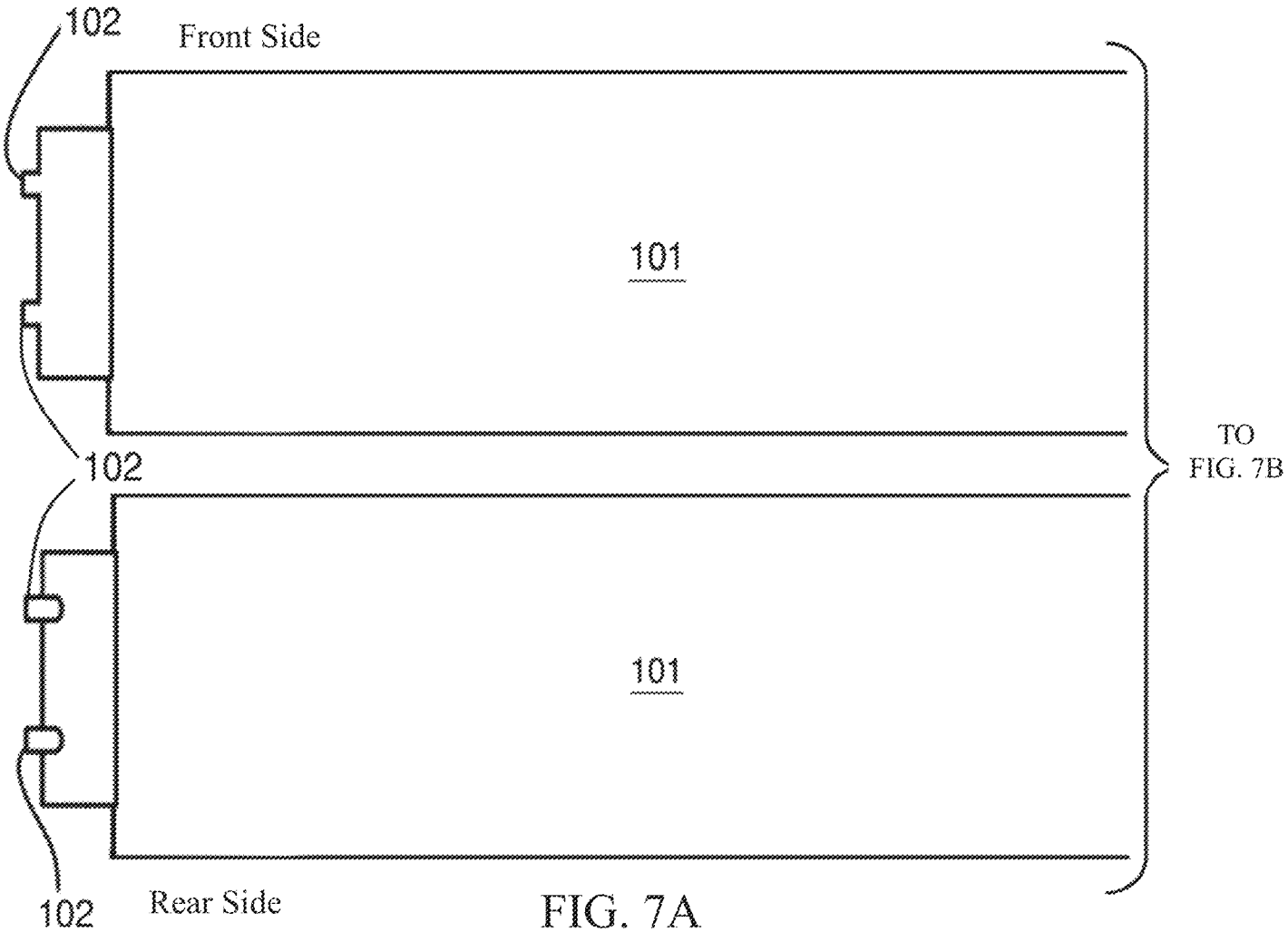
FIGS. 7A-7I illustrate corresponding front side and back side sections of the present invention side by side in an enlarged detailed view, wherein for the purpose of illustrating the entire length of the device in more detail, each of the figures show a different section of the device.
Figure 7B:
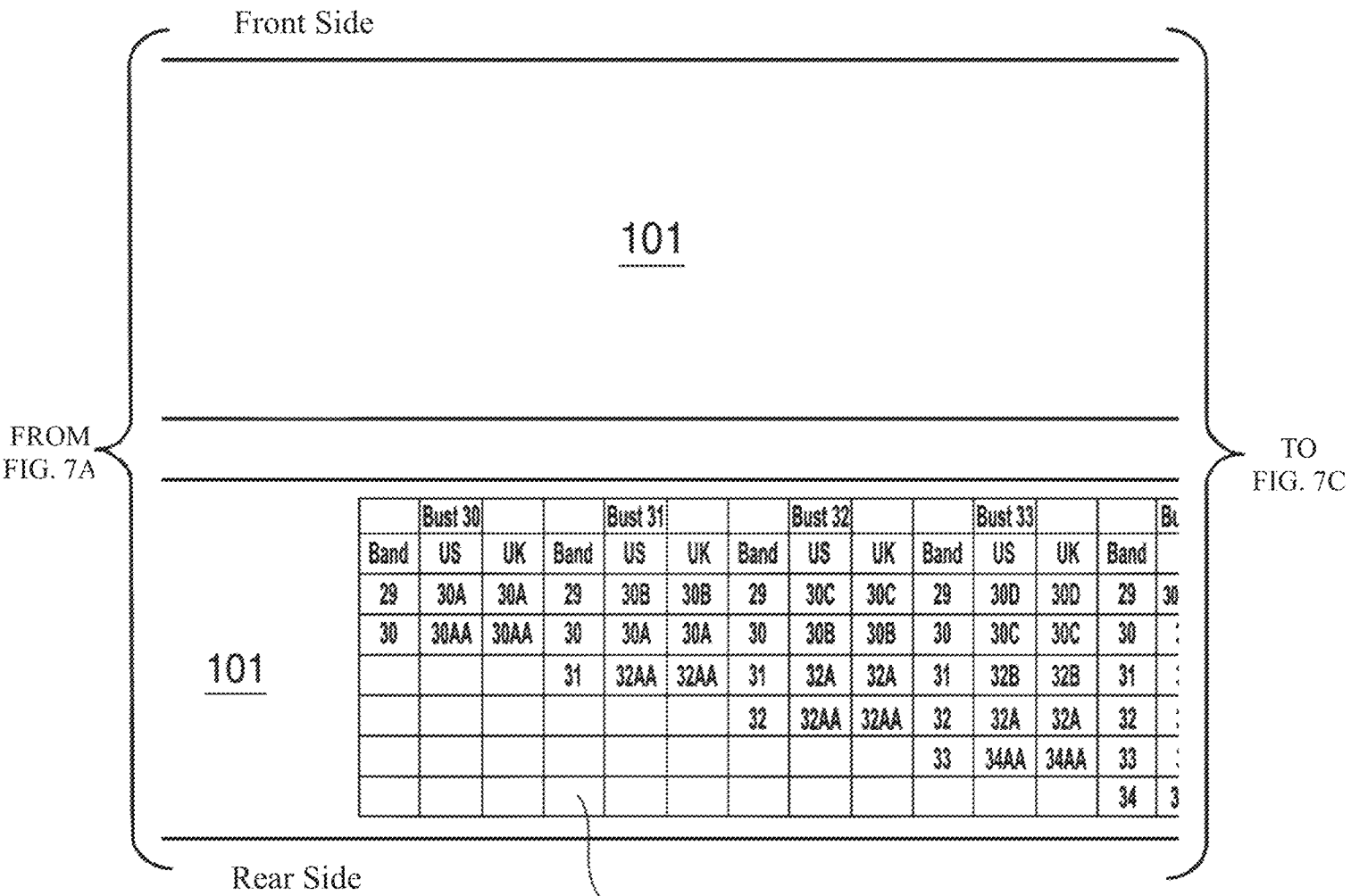
Figure 7C:
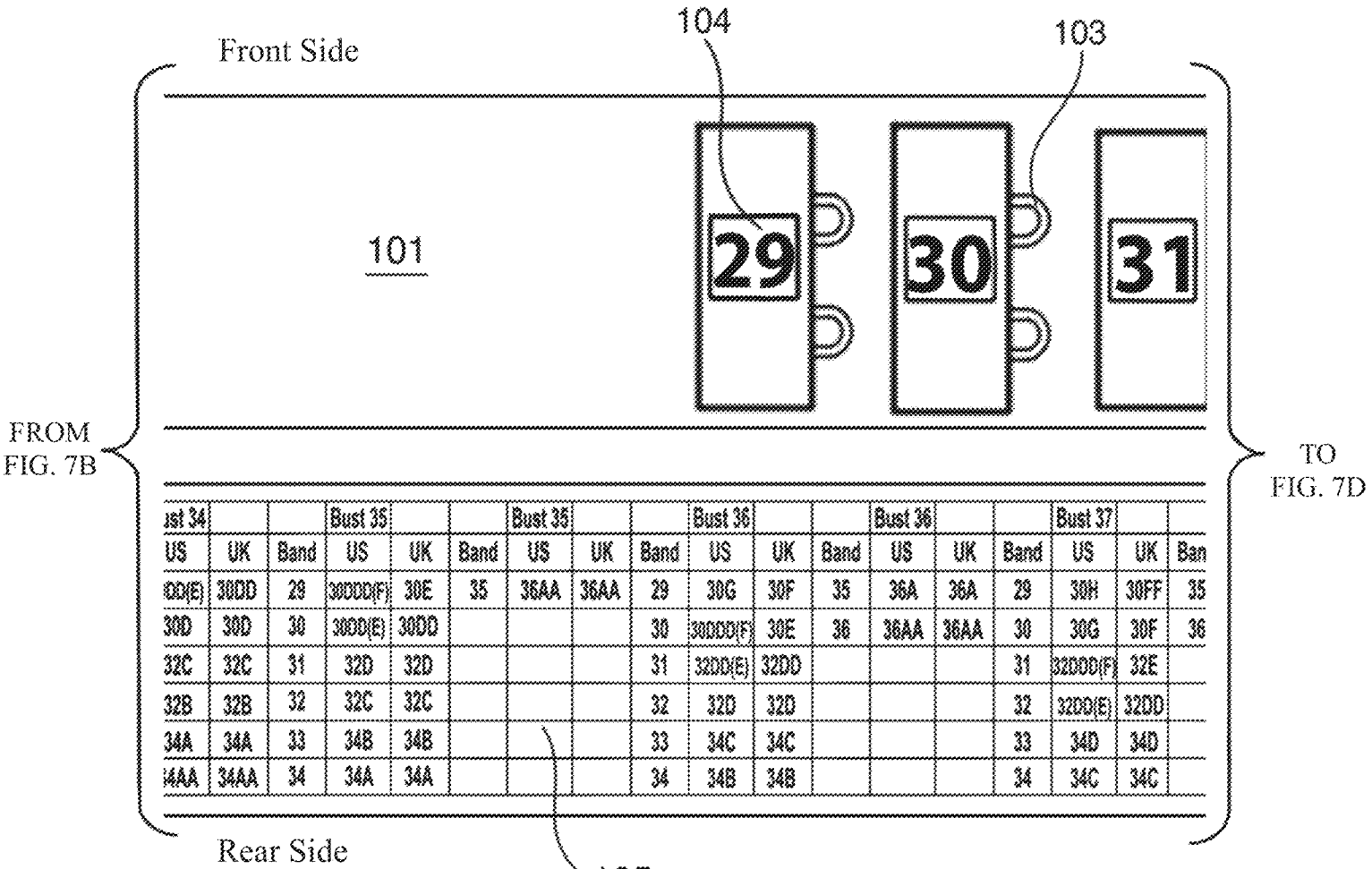
Figure 7D:
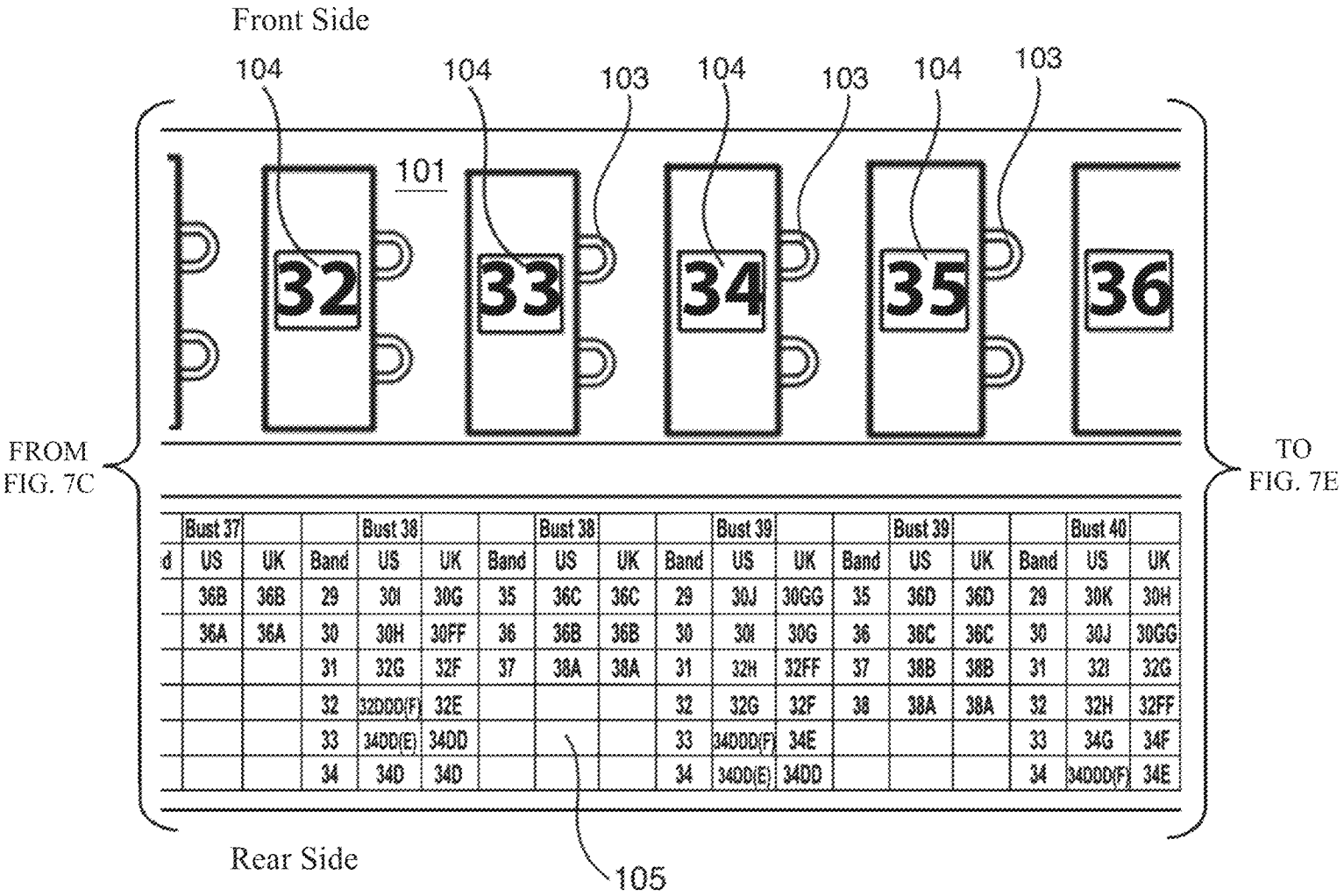
Figure 7E:
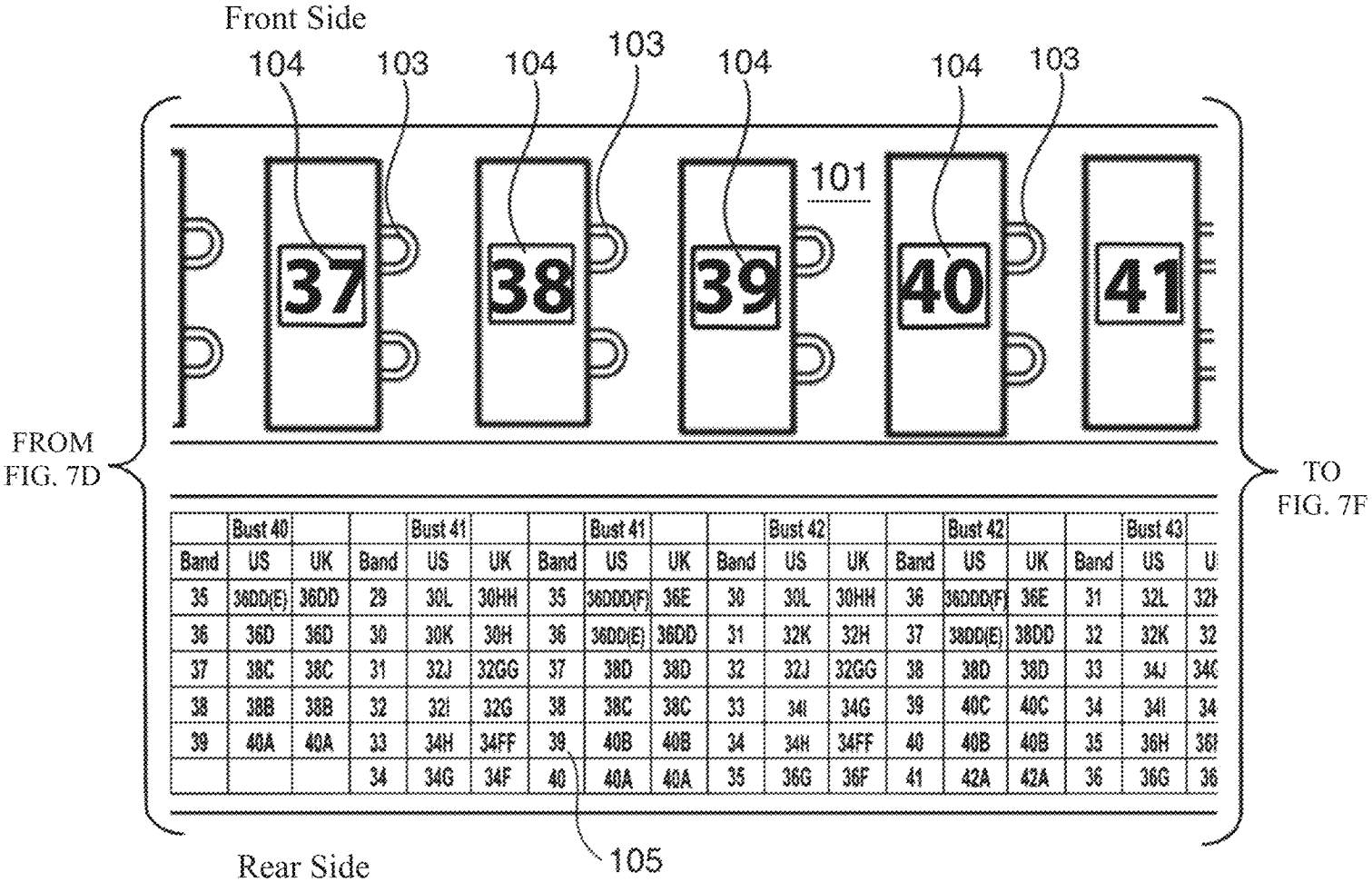
Figure 7F:
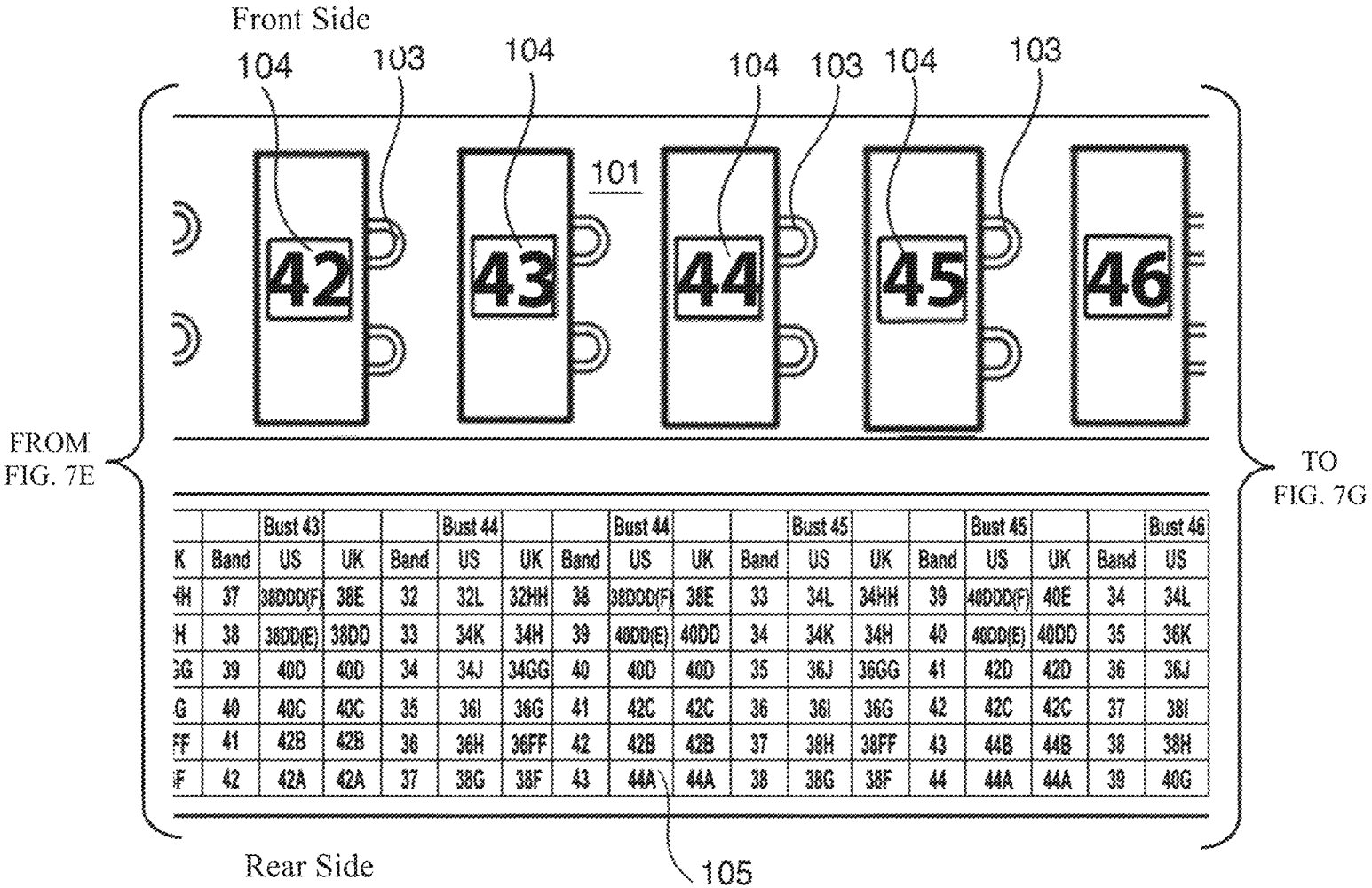
Figure 7G:
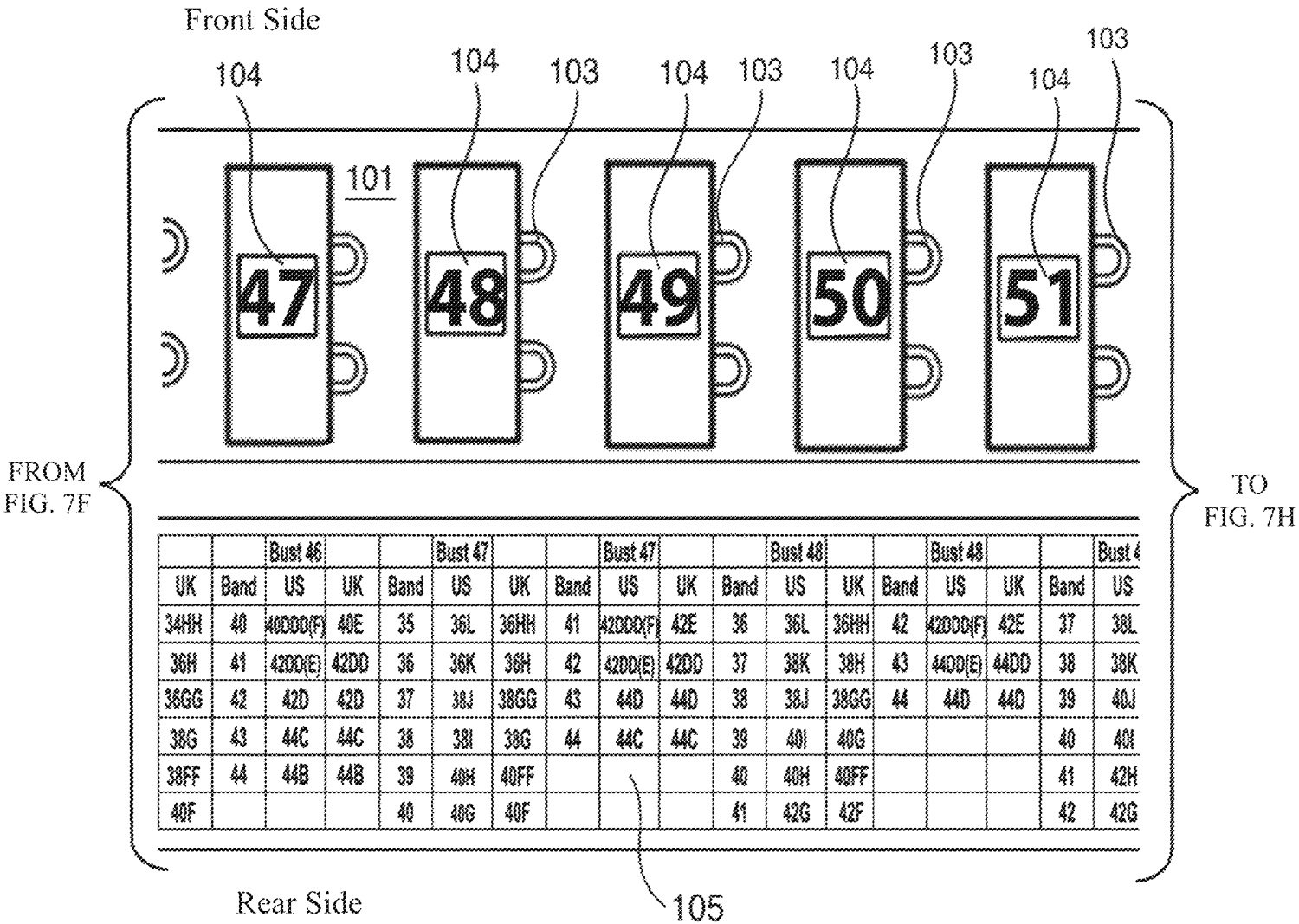
Figure 7H:
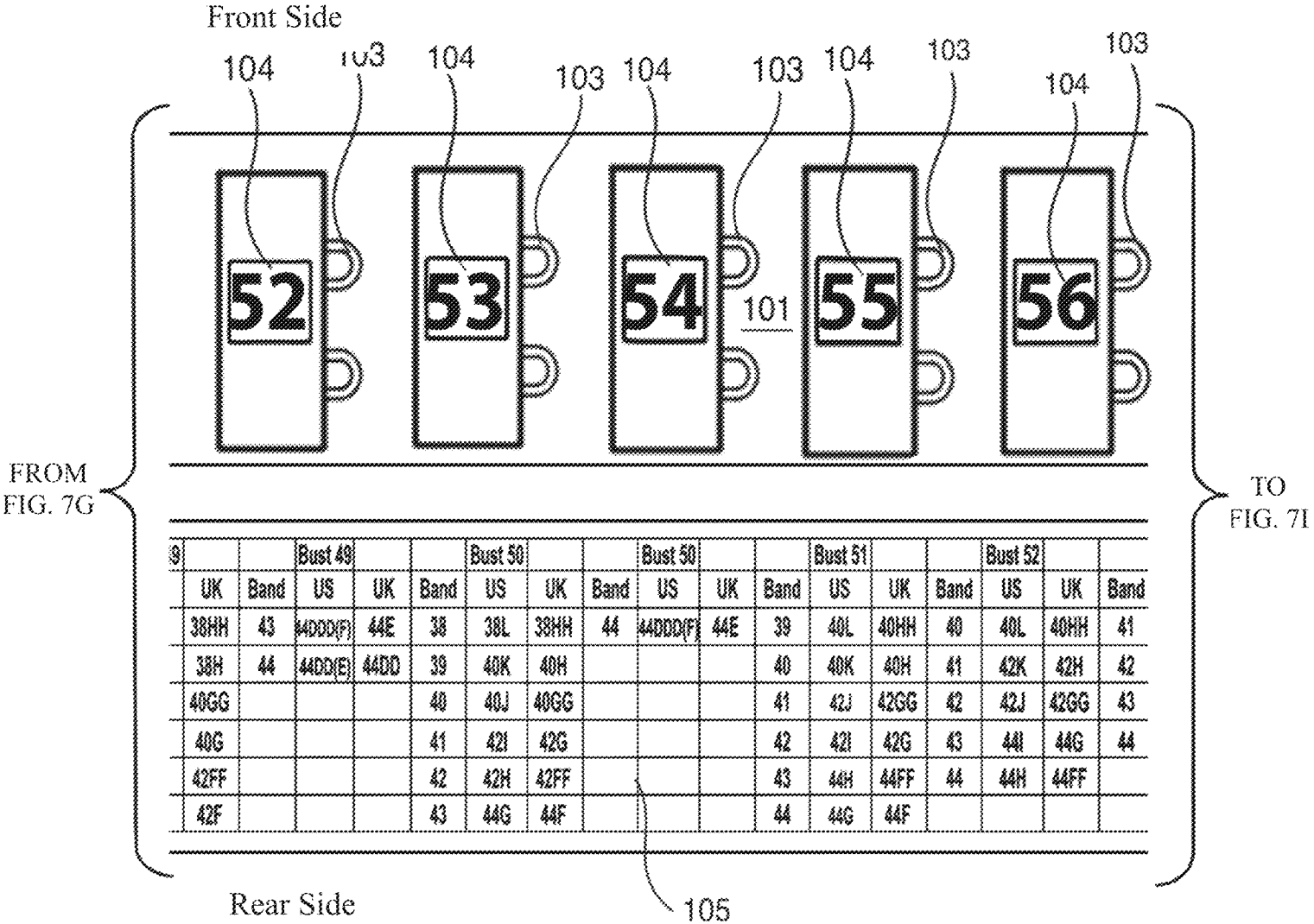
Figure 7I:
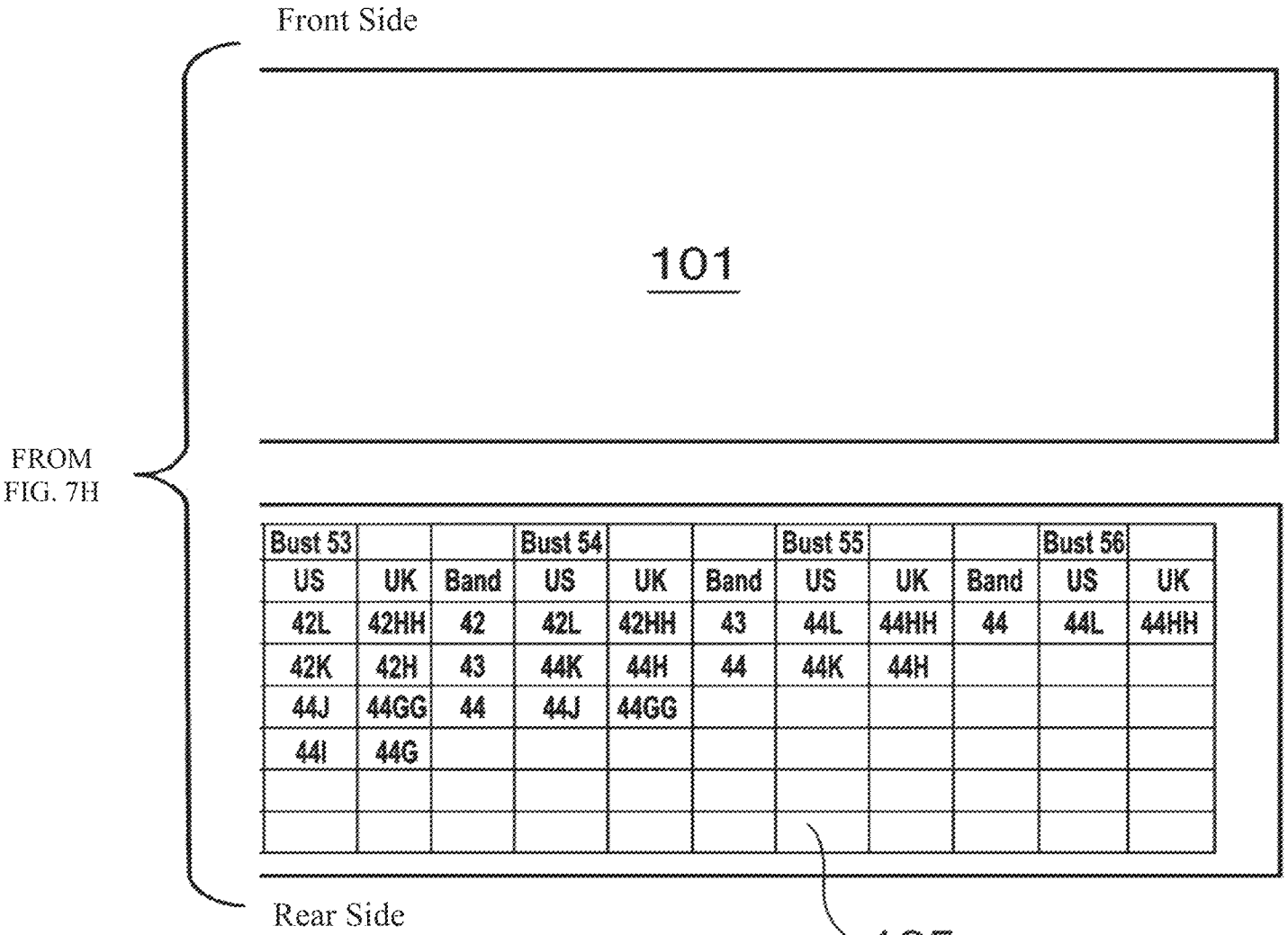

According to the exemplary embodiment the second closure elements 103 eye loops may be sewn into material resembling bra extender back closures and subsequently attached onto the measuring strip 101. This allows for the second closure elements 103 eye loops to be slightly raised and the first closure element 102 hooks to be fastened to the second closure elements 103 eye loops in a more ergonomic fashion. FIG. 6 shows an enlarged elevation view of the second closure elements 103 as eye loops attached to the measuring strip 101 in this fashion. In other embodiments the second closure elements 103 eye loops may be sewn or attached directly onto the measuring strip 101.

The second closure elements 103 are sewn or attached to the measuring strip 101 starting at the smallest underbust measurement and ending at the largest overbust measurement for the size range the measuring device 100 would measure. In one embodiment of the invention each second closure element 103 is placed one inch apart from each other moving from left to right down the front side or first surface of the measuring strip 101. In other embodiments the incremental difference between the second closure elements 103 may be in centimeters or other metric units depending on the metric unit used for bra sizing in a particular geographic world region. Each individual second closure element 103 is attached to the measuring strip 101 at measurement increments that correspond to the circumference measurement sizes of the measuring device 100 representing underbust and overbust measurements when the measuring device 100 is wrapped around the torso of a user in an enclosed loop position.

In a preferred embodiment of the invention the circumference measurement sizes of the measuring device 100 that correspond to the second closure elements 103 are in the metric unit of inches. The first closure element 102 and the second closure elements 103 are hook and eye components paired in twos. The first pair of second closure elements 103 eye components are sewn and/or attached on top of the first surface of the measuring strip 101 29 inches to the right of the first closure element 102 pair of hooks. 27 additional pairs of second closure elements 103 eye components are sewn or attached to the first surface of the measuring strip 101 on the front side of the measuring device 100 moving left to right down the measuring strip 101 spaced one inch apart. There are a total number of 28 pairs of second closure elements 103 corresponding with the circumference measurement sizes of 29-56 inches of the measuring device 100 when the measuring device 100 is in a closed loop configuration. This embodiment of the invention is designed to measure and provide bra size measurements for sizes ranging from 30 AA-44L U.S. (i.e., 30AA-44HH U.K.), with an underbust measurement range of 29 inches to 44 inches and an overbust measurement range of 30 inches to 56 inches.

Number indicia 104 are printed or attached onto the second closure elements 103 or attached directly on the measuring strip 101 to label the second closure elements 103 and indicate the circumference measurement sizes of the measuring device 100. The top portions of FIGS. 7C through 7H are enlarged front side views of the measuring device 100 that show the second closure elements 103 attached to the measuring strip 101 with the corresponding number indicia 104.

As shown in FIG. 2 and FIG. 4 the bra size measurement conversion charts 105 are located on the rear or second side of the measuring device 100 in the exemplary embodiment. The bottom portions of FIGS. 7B through 7I are enlarged rear side views of the device 100 that show the bra size measurement conversion charts 105. The charts 105 include odd numbered underbust measurements and properly convert the measurements to the correct even numbered bra band size with the appropriate cup size. This feature limits confusion for users and inaccurate sizing is avoided even if the user's underbust measurement falls in between the even-numbered bra band sizes on an odd-numbered underbust measurement. The charts 105 list the possible bra size band to bust ratio measurement combinations within a certain size range. This helps the user with adjusting their size if needed.

Figure 8:
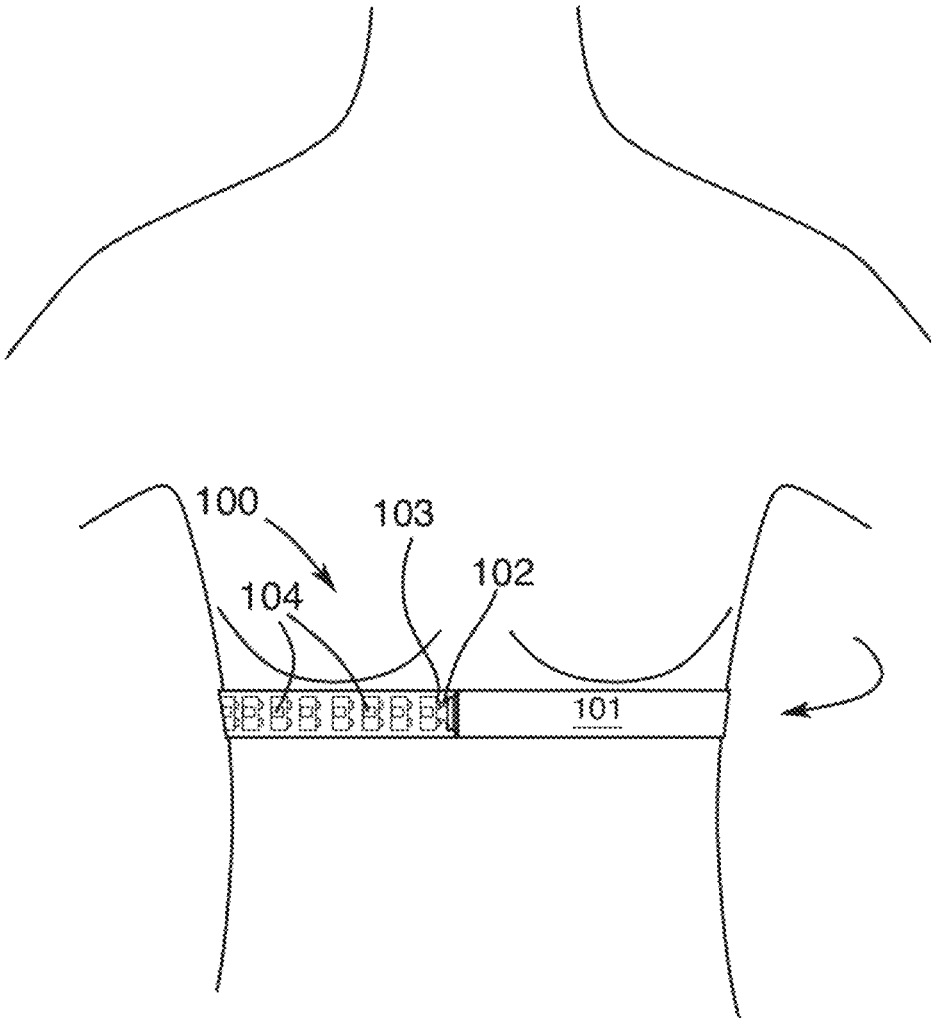
FIG. 8 illustrates the proper location of the device for taking the underbust measurement for determining the band measurement using the first or front side of the device.
Figure 9:
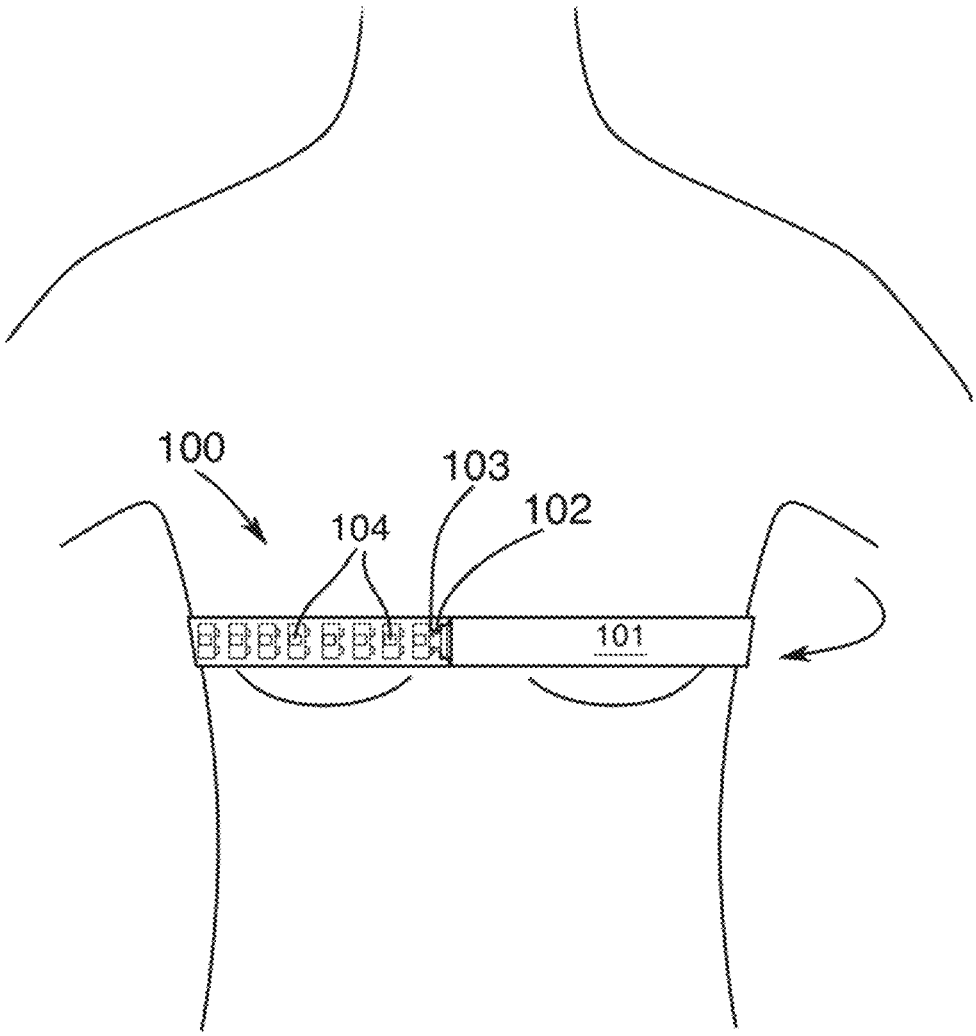
FIG. 9 illustrates the proper location of the device for taking the overbust measurement for determining the bust measurement using the first or front side of the device.

The distinct circumference measurement sizes of the measuring device 100 indicated by the number indicia 104 on the second closure elements 103 are listed as band and bust measurements on the bra size measurement conversion charts 105. Bust measurements represent the circumference measurement size of the measuring device 100 when measuring the overbust measurement of a user at the apex of the breasts. FIG. 9 illustrates the measuring device 100 measuring the bust measurement. Band measurements represent the circumference size of the measuring device 100 when measuring the underbust measurement of a user just below the breast. FIG. 8 illustrates the measuring device 100 measuring the band measurement.

The bra size measurement conversion charts 105 are categorized by the bust measurements. Each category of bust measurements is a different section within the charts 105. In the exemplary embodiment the sections are placed one after the other from left to right along the rear side of the measuring device 100. Within the sections the bust measurements are listed horizontally at the upper most row of each individual section and the band measurements are listed vertically at the left most column of each individual section. The user may find their bra size by finding the cell within the charts 105 that intersects with both their horizontal row bust measurement and their vertical column band measurement. In some embodiments the sections of the charts 105 may be categorized by the band measurements with the band measurements listed horizontally and the bust measurements listed vertically. In some embodiments the charts 105 may be provided on a separate physical or digital medium. In some embodiments the charts 105 may include half inch increments to include half cup sizes. For embodiments that accommodate a larger size range, bust and/or band measurements may be categorized over multiple sections of the charts 105 for the sake of printing space on the measuring device 100. FIGS. 7C through 7G shows an example of bust measurements printed over multiple sections of the charts 105. In one embodiment of the invention as depicted in FIG. 10 the color and/or shading of each section of the bra size measurement conversion charts 105 alternate for easier reading.

The bra size conversion charts 105 may also convert bra sizes according to which bra size metric system is being used for a particular lingerie brand. Different manufacturers use different metric systems for sizing depending on the world region and/or country of origin of the bra. The United States and the United Kingdom use inches to determine a bra band size while Europe and France use centimeters with the French size being 15 centimeters larger than the European size. The cup size can also be different letters for the same bust measurement depending on the world region and/or country of origin of a bra. For example, a 34DDD(F) in the United States is equivalent to a 34E in the United Kingdom. In the exemplary embodiment FIGS. 7A through 7I show bra sizes listed according to the United States bra size metric system indicated by the US column and the United Kingdom bra size metric system indicated by the UK column. This feature of the invention is intended to limit confusion and help the user convert their bra size according to which lingerie brand they may be shopping. In other embodiments, bra sizes may be converted to represent sizing metrics from France, Europe, China, Australia, or any other region of the world where different numerical or alphabetical bra size metric systems are used.

To operate the measuring device 100 a user would find their most desirable overbust measurement. With the second closure elements 103 facing away from the body the user would wrap the measuring device 100 around their torso at the apex of the bust across the nipple line and fasten the first closure element 102 to an individual second closure element 103 as shown in FIG. 9. The user would want to ensure that the device sits evenly around their torso. The user may try out different second closure elements 103 for determining the best size, choosing a size that would allow the measuring device 100 to be worn securely across the nipple line without the need of having to hold the measuring device 100 in place. The user would also ensure the measuring device 100 is not unduly constricting indicated by the measuring device 100 excessively compressing the breast tissue. The best overbust circumference measurement chosen by the user would be the user's bust measurement.

The user would also find their most desirable underbust circumference measurement by wrapping the measuring device 100 around their torso directly under the bust and fastening the first closure element 102 to an individual second closure element 103 of their liking as shown in FIG. 8. The user would test the comfort of different underbust circumference measurements indicated by how tightly the measuring device 100 feels, and the support of different underbust circumference measurements indicated by the orientation of where the measuring device 100 sits around the user's torso with reference to the underbust breast roots. Breast roots is a term used to indicate the point on the body where the breast tissue is attached to the chest wall. Choosing a tighter underbust circumference measurement secures the measuring device 100 higher up the torso under the bust bringing the measuring device 100 closer to the underbust breast roots. Choosing a looser underbust circumference measurement secures the measuring device 100 further down the torso under the bust bringing the measuring device 100 further away from the underbust breast roots. The closer the measuring device 100 is to the underbust breast roots when measuring the underbust, the more support the chosen circumference measurement size will have. The user would choose their underbust measurement according to their subjective comfort and support level and that underbust measurement would be the user's band measurement.

The user would then take the chosen bust and band measurements and reference the charts 105 to obtain their bra size. Because the user can test the feel of bra size measurements in one inch increments, an accurate bra size is able to be calculated. Measurements for both the bust and band may be performed while wearing a tight shirt, an unpadded bra, or while unclothed.

In one embodiment of the invention additional bra fitting educational information may be printed on the front or first side of the measuring device 100 to the left of the second closure elements 103. Additional bra fitting educational information may also be printed on the rear or second side of the measuring device 100 to the left of the charts 105 along with instructions on how to use the device. The additional bra fitting information may include but is not limited to bra style recommendations for particular breast shapes, bra fitting tips on how to properly adjust the components of a bra, when to adjust the bra cup size to a larger or smaller cup size depending on how the bra fits, and how to adjust the measured size to one's sister size (which is an alternative size option) if needed.

It shall be appreciated that the number of closure elements used for the first closure element 102 and the number of closure elements used for the second closure elements 103 on each measurement increment may increase or decrease transversely along the width of the device (i.e., two second closure elements 103 eye loops per measurement increment can be changed to three second closure elements 103 eye loops per measurement increment or vice versa) depending on the width of the measuring device 100. The first closure element 102, second closure elements 103, and number indicia 104 may be added or removed in various quantities and placed on either side of the measuring strip 101. The length and width of the measuring device 100 may increase or decrease and the size range that the measuring device 100 measures may increase or decrease. The measuring device 100 may be of any size for accommodating any number of first closure elements 102, second closure elements 103, and bra size measurement conversion charts 105 for extended bra sizes. The bra size range, charts 105 configuration, order of the charts 105, style, and/or language of the bra size conversion charts 105 may vary in alternate embodiments.

It shall be appreciated that the first closure element 102 and the second closure elements 103 may be made of any material and any other types of closure elements may be used in alternate embodiments. Any other closure/fastener elements, such as buttons, snaps, zippers, belt buckles, adhesive, overlapping sliding components, various types of clasps, fabric ties, frog closures, eyelets, grommets, laces, loop fasteners, magnets, pins, poppers, press studs, safety pins, studs, snap fasteners, toggles, tape with male and female components, etc. may be used in alternate embodiments.

It shall be appreciated that the disclosed device can have multiple configurations in different embodiments and may be adapted for use in one or more different countries based on the sizing metric system and/or language of the country. In some embodiments the disclosed device may be used for determining other measurements, such as head size, waist size, or any other circumference size of a body part. The charts 105 may also be reconfigured to represent different body part measurements. It shall be appreciated that the components of the disclosed device including the first closure element 102, second closure elements 103, number indicia 104, and bra size conversion charts 105, may be provided in various formats that may incorporate artistic elements, and may be placed at different locations, and/or relative orders on the measuring strip 101. It shall be understood that any material described as "printed on the measuring strip 101" may be printed directly on the measuring strip 101 or may be printed on a separate material which may be attached to the measuring strip 101. In other embodiments, some or all of these components printed on the measuring strip 101 may be omitted or provided on a separate physical or electronic medium outside of the measuring strip 101. Other elements may also be printed on the measuring strip 101, such as logos, artwork, advertisements, etc.

It shall be appreciated that the device and methodology described herein may comprise any alternative known materials in the field and be of any color, size, and/or dimensions. It shall be appreciated that the device may be manufactured and assembled using any known techniques in the field.

It shall be understood that the orientation or positional relationship indicated by terms such as "upper", "lower", "front", "rear", "left", "right", "top", "bottom", "inside", "outside" is based on the orientation or positional relationship shown in the accompanying drawings, which is only for convenience and simplification of describing the disclosed subject matter, rather than indicating or implying that the indicated measuring device 100 or elements must have a specific orientation or are constructed and operated in a specific orientation, and therefore should not be construed as a limitation of the present invention.

The constituent elements of the disclosed device listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' 'substantially,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the invention. Thus, given the wide variety of configurations and arrangements of embodiments of the present invention the scope of the invention is reflected by the breadth of the claims below rather than narrowed by the embodiments described above.

We claim:

1. A bra size measurement comparison device comprising:

a measuring strip comprising a length of continuous strip material having a first surface and a second surface opposite said first surface, the first surface and the second surface having a common top linear edge and a common bottom linear edge, the top linear edge and the bottom linear edge being oppositely disposed and spanning the length of the strip material;

the measuring strip further including a first side edge extending between a first end of the top linear edge and a first end of the bottom linear edge, and a second side edge extending between a second end of the top linear edge and a second end of the bottom linear edge;

the first edge and the second edge spanning across a width of the strip material, the width being shorter than the length such that the measuring strip provides a long and narrow band;

a first closure element attached to proximate the first end of the measuring strip;

a row of second closure elements attached to the first or second surface of the measuring strip, wherein each second closure element within the row of second closure elements is labeled and/or numbered, and each label and/or number of the second closure elements corresponds to a distinct circumference measurement size of the measuring strip;

wherein the first closure element is configured to independently fasten to each second closure element within the row of second closure elements so that the measuring strip forms a loop and may be worn around a user's torso while measuring to obtain an underbust measurement and an overbust measurement;

wherein the measuring strip is self supporting when worn around the torso, and omits both breast cupping surfaces and shoulder straps; and a group of bra size measurement conversion charts located on the first surface and/or the second surface of the measuring strip, wherein the group of bra size measurement conversion charts convert the measurements taken by the measuring strip into exact bra sizes.

2. The bra size measuring device of claim 1, wherein the first surface is a front side outer surface of the device, and the second surface is a rear side outer surface of the device.

3. The bra size measuring device of claim 1, wherein the first closure element and each second closure element within the row of second closure elements comprise any means of fastening.

4. The bra size measuring device of claim 1, wherein the group of bra size conversion charts display a single bra size metric system or multiple bra size metric systems from different world regions and/or countries, and an exact bra size is displayed one way or displayed multiple ways with different numbering and/or lettering so that the exact bra size corresponds with one bra sizing metric system or multiple bra sizing metric systems used in different world regions and/or countries.

5. A method for determining bra size of a pair of breasts, comprising the steps of:

wrapping a measuring device around a torso at an apex of the pair of breasts, wherein the measuring device comprises a length of continuous and narrow strip material having a top linear edge and a bottom linear edge, omits both breast cupping surfaces and shoulder straps, and having a first closure element and a row of second closure elements, wherein each second closure element within the row of second closure elements is labeled and/or numbered and corresponds to a distinct circumference measurement size of the measuring device;

fastening the first closure element of the measuring device to one of the second closure elements within the row of second closure elements on the measuring device so that the device may be worn self-supportively around the apex of the pair of breasts and obtain an overbust circumference measurement size of the torso;

comparing the tightness and constraints of different overbust circumference measurement sizes of the measuring device around the apex of the pair of breast by fastening the first closure element of the device to different second closure elements on the device;

choosing an overbust circumference measurement size from the different overbust circumference measurement sizes compared;

wrapping the measuring device around the torso directly under the pair of breasts;

fastening the first closure element of the measuring device to one of the second closure elements within the row of second closure elements on the measuring device so that the device may be worn self-supportively directly under the pair of breasts and obtain an underbust circumference measurement size of the torso;

comparing the tightness and constraints of different underbust circumference measurement sizes of the measuring device under the pair of breasts by fastening the first closure element of the device to different second closure elements on the device;

choosing an underbust circumference measurement size from the different underbust circumference measurement sizes compared that is the desired tightness around the torso under the pair of breasts and keeps the measuring device securely in place at the desired position around the torso under the pair of breasts; and referencing bra size conversion charts that have overbust and underbust circumference measurements listed with corresponding bra sizes and finding the chosen overbust and underbust circumference measurements on the charts to determine an exact bra size.

* * * * *